United States Patent [19]

Holmes

[11] Patent Number: 5,016,731

[45] Date of Patent: May 21, 1991

[54] ARTICULATED BOOM INCLUDING TENSIONING APPARATUS

[75] Inventor: William K. Holmes, Delafield, Wis.

[73] Assignee: Hi-Ranger, Inc., Waukesha, Wis.

[21] Appl. No.: 36,009

[22] Filed: Apr. 8, 1987

[51] Int. Cl.[5] ..... B66F 11/04

[52] U.S. Cl. ..... 182/2; 254/228

[58] Field of Search ..... 182/2, 63, 141; 254/228

[56] References Cited

U.S. PATENT DOCUMENTS

| | | | |
|---|---|---|---|
| 2,063,802 | 12/1936 | Geary | 74/586 |
| 2,323,352 | 7/1943 | Pitts | 74/501 |
| 3,023,475 | 3/1962 | Yerby et al. | 254/228 X |
| 3,049,194 | 8/1962 | Brendel | 189/31.5 |
| 3,298,663 | 1/1967 | Hextell | 254/228 |
| 3,302,480 | 2/1967 | Puryear et al. | 74/501.5 |
| 3,326,524 | 6/1967 | Taylor | 254/228 |
| 4,081,055 | 3/1978 | Johnson | 182/2 |
| 4,360,187 | 11/1982 | Chapman | 182/2 X |
| 4,429,763 | 2/1984 | Houck | 182/2 |
| 4,484,732 | 11/1984 | Gould | 267/64.14 |
| 4,512,436 | 4/1985 | Freudenthal et al. | 182/2 |

*Primary Examiner*—Alvin C. Chin-Shue

*Attorney, Agent, or Firm*—Michael, Best & Friedrich

[57] ABSTRACT

An aerial lift comprising a frame, an articulated boom including a first and second boom portions, a workman support structure mounted on the upper end of the second boom portion for pivotal movement relative thereto about a generally horizontal axis, and a mechanism for leveling the workman support structure throughout the range of movement of the first and second boom portions, the leveling mechanism including first and second sections of elongate material extending through the boom portions, a hydraulic assembly connected to the second section and including a hydraulic cylinder, a piston dividing the cylinder into first and second chambers, and a piston rod having one end fixedly connected to the piston, and a hydraulic accumulator communicating with one of the chambers.

15 Claims, 2 Drawing Sheets

ARTICULATED BOOM INCLUDING TENSIONING APPARATUS

BACKGROUND OF THE INVENTION

The invention relates to articulated booms, and more particularly to articulated booms including an arrangement for leveling the workman support bucket.

A conventional articulated boom comprises a pair of elongated boom portions that are pivotally joined together. The lower end of one of the portions is pivotally mounted on a frame, and the upper end of the other portion supports a pivotally mounted bucket in which a workman rides. The boom also comprises means for leveling the bucket throughout the range of movement of the boom portions. This means typically includes a closed loop of flexible, elongate material, such as a cable or chain, which extends through the boom from the frame to the bucket and which is supported by pulleys or sprockets. A portion of this loop, referred to as the tension portion, resists downward tilting movement of the bucket and thus is maintained under tension by the force of gravity acting on the bucket. The remainder of the loop, called the holdback portion, is not maintained under tension by the bucket.

Articulated booms are commonly mounted on trucks, and it is desirable to maintain tension in the loop so that the bouncing which inevitably occurs when the boom is being transported does not cause the loop to come off its pulleys or sprockets and does not cause damage to the loop itself or to other components within the boom. Maintaining the loop under constant tension also reduces elongation of the loop when it is loaded, such as when a workman enters the bucket.

Houck U.S. Pat. No. 4,429,763 discloses an arrangement in which turnbuckles are provided for adjusting the tension in the loop. A disadvantage of using turnbuckles is that it is necessary to frequently tighten the turnbuckles in order to maintain tension. Another disadvantage of using turnbuckles is that the closed loop is typically enclosed within the boom portions and it is necessary to provide access to the interior of the boom portions in order to afford access to the turnbuckles. For example, in the Houck patent, access plates 13' and 14' are provided to afford access to the turnbuckles. Thus, it is necessary to remove the access plates each time the turnbuckles are tightened.

Attention is directed to the following U.S. Pat. Nos.

| | | |
|---|---|---|
| Johnson | 4,081,055 | Mar. 28, 1978 |
| Freudenthal, et al. | 4,512,436 | Apr. 23, 1985 |
| Houck | 4,429,763 | Feb. 7, 1984 |
| Brendel | 3,049,194 | Aug. 14, 1962 |
| Geary | 2,063,802 | Dec. 8, 1936 |
| Gould | 4,484,732 | Nov. 27, 1984 |
| Pitts | 2,323,352 | Jul. 6, 1943 |
| Puryear, et al. | 3,302,480 | Feb. 7, 1967 |

SUMMARY OF THE INVENTION

The invention provides an aerial lift comprising a frame, and an articulated boom including lower and upper boom portions. The lower end of the lower boom portion is pivotally mounted on the frame, and the upper end of the upper boom portion has pivotally mounted thereon a workman support structure or bucket. The articulated boom also includes means for causing pivotal movement of the lower boom portion relative to the frame, and means for causing pivotal movement of the upper boom portion relative to the lower boom portion. These means preferably include hydraulic assemblies powered by a hydraulic pump. The boom also includes means for leveling the workman support bucket throughout the range of movement of the upper and lower boom portions. The leveling means includes tension and holdback sections of elongated material extending through the boom portions from the lower end of the lower boom portion to the workman support bucket. Preferably, the tension and holdback sections are part of a closed loop of elongate material. The holdback section includes first and second segments.

The aerial lift also comprises means for maintaining tension in the holdback section. This means includes a hydraulic cylinder having opposite first and second ends, with the first end of the cylinder being connected to one of the segments of the holdback section, a piston dividing the cylinder into first and second chambers respectively adjacent the first and second ends of the cylinder, and a piston rod extending through the second chamber and having one end fixedly connected to the piston and an opposite end connected to the other segment of the holdback section.

In the preferred embodiment, the means for maintaining tension further includes a hydraulic accumulator communicating with the second cylinder chamber. The accumulator, which is preferably located inside the articulated boom, automatically maintains the tension in the holdback section by pressurizing the second cylinder chamber. Therefore, it is not necessary to provide access to the interior of the boom in order to adjust the tension in the holdback section.

In an alternative embodiment, the second cylinder chamber communicates, via a pressure reducing valve and a check valve, with the hydraulic pump rather than with a hydraulic accumulator. This arrangement causes the second cylinder chamber to be pressurized every time the pump is turned on.

A principal feature of the invention is the provision of means for automatically maintaining tension in the holdback section. With known turnbuckle arrangements, tension is decreased by stretching or elongation of the elongate material in the holdback section. With the disclosed arrangement, the hydraulic accumulator both reduces stretching of the elongate material and also maintains the desired tension in the holdback section regardless of stretching of the elongate material.

Other principal features and advantages of the invention will become apparent to those skilled in the art upon review of the following detailed description, claims and drawings.

Figure 3:
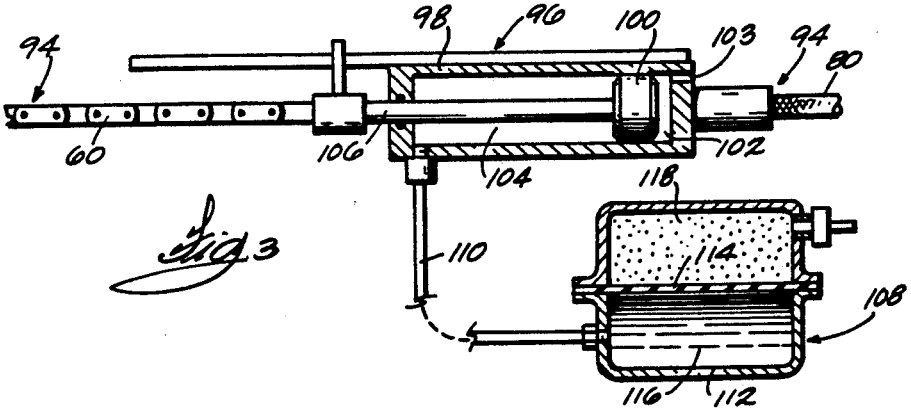
FIG. 3 is a further enlarged view, partially schematic, of the tension maintaining means.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 1:
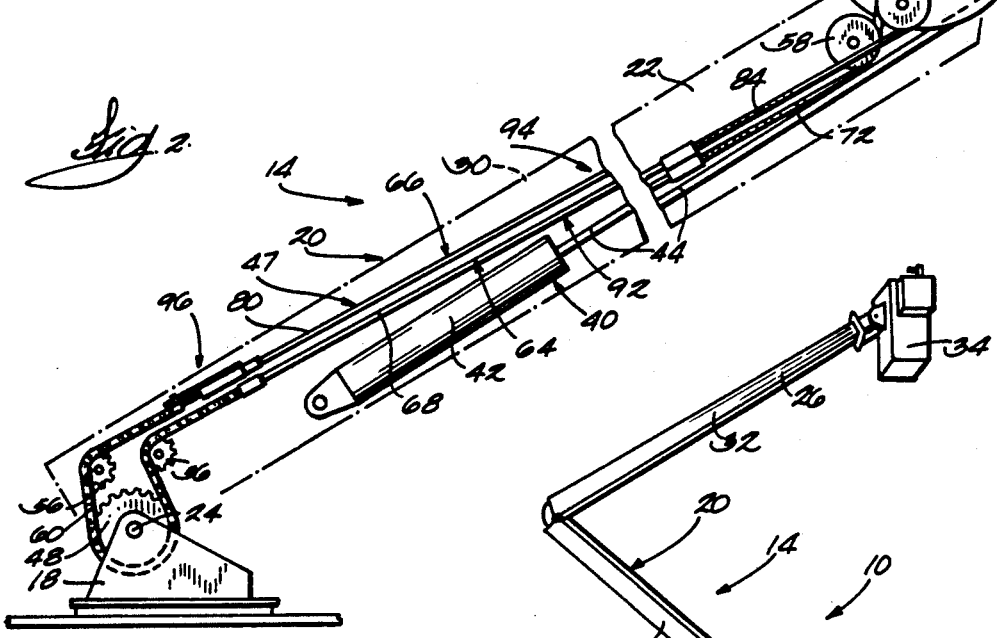
FIG. 1 is a perspective view of a vehicle apparatus embodying the invention.

An apparatus 10 embodying the invention is illustrated in the drawings. As best shown in FIG. 1, the apparatus 10 comprises a vehicle or truck 12, and an aerial lift 14 mounted on the truck 12. More specifically, the truck 12 has mounted on the rear end thereof a conventional turntable 16, and the aerial lift 14 is mounted on the turntable 16 for pivotal movement relative to the truck 12 about a generally vertical axis.

The aerial lift 14 comprises a frame 18 mounted on the turntable 16, and an articulated boom 20 including a first or lower boom portion 22 having an upper end, and a lower end pivotally mounted on the frame 18 for pivotal movement relative thereto about a generally horizontal axis 24. The articulated boom 20 also includes a second or upper boom portion 26 having an upper end, and a lower end mounted on the upper end of the lower boom portion 22 for pivotal movement relative thereto about a generally horizontal axis 28. The boom portions 22 and 26 include respective housings 30 and 32, preferably made of steel and fiber reinforced plastic, which house the internal components of the boom 20. The boom 20 further includes a workman support structure or bucket 34 mounted on the upper end of the upper boom portion 26 for pivotal movement relative thereto about a generally horizontal axis 36.

Figure 2:
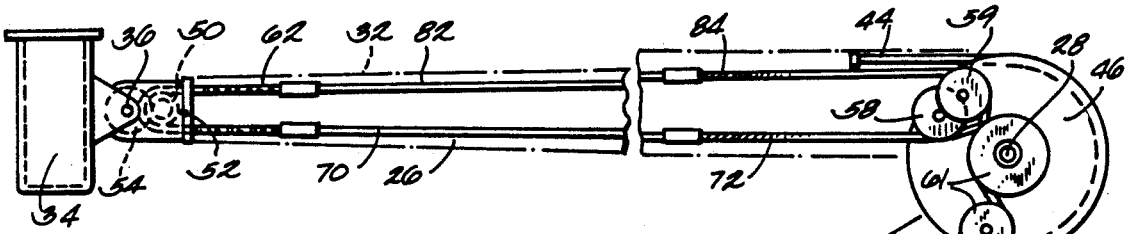
FIG. 2 is an enlarged view, partially broken away, of the boom.

The articulated boom 20 further includes means for causing pivotal movement of the lower boom portion 22 relative to the frame 18, and means for causing pivotal movement of the upper boom portion 26 relative to the lower boom portion 22. While various suitable means can be employed, in the preferred embodiment, the means for causing pivotal movement of the lower boom portion 22 includes (see FIG. 1) a hydraulic assembly 38 connected between the frame 18 and the lower boom portion 22, and the means for causing pivotal movement of the upper boom portion 26 includes a hydraulic assembly 40. As best shown in FIG. 2, the assembly 40 includes a cylinder and piston assembly 42 mounted within the lower boom portion housing 30, and a flexible, elongate member 44 which extends from the cylinder and piston assembly 42, which passes over a pulley 46 mounted for pivotal movement on the axis 28, and which is connected to the upper boom portion 26. This arrangement is conventional and will not be described in greater detail.

The hydraulic assemblies 38 and 40 are powered by a hydraulic pump 41 communicating with a reservoir 43. As shown schematically in FIG. 4, the pump 41 communicates with the hydraulic assemblies 38 and 40 via respective control valves 150 and 152. This arrangement is also conventional.

The articulated boom 20 also includes means for leveling the workman support bucket 34 throughout the range of pivotal movement of the boom portions 22 and 26. While various suitable leveling means can be used, in the illustrated construction, the leveling means includes a closed loop 47 of flexible, elongate material extending through the boom portions 22 and 26 and within the housings 30 and 32 from the lower end of the lower boom portion 22 to the workman support bucket 34. More particularly, the leveling means includes a first or lower sprocket 48 fixedly connected to the frame 18 and centered on the axis 24, and a second or upper sprocket 50 pivotally mounted on the upper end of the upper boom portion 26. The upper sprocket 50 engages, via a single gear reduction 52, a sprocket 54 which is pivotally mounted on the end of the upper boom portion 26 for rotation about the axis 36, and which is fixedly connected to the workman support bucket 34. Thus, pivotal movement of the upper sprocket 50 causes pivotal movement of the sprocket 54 and pivotal movement of the bucket 34. The leveling means also includes idler sprockets 56 mounted in the lower end of the lower boom portion 22, and pulleys 58, 59 and 61 mounted in the upper end of the lower boom portion 22 and in the lower end of the upper boom portion 26. This arrangement is conventional and will not be described in greater detail.

In the preferred embodiment, the closed loop 47 includes a first or lower chain 60 extending over the lower sprocket 48, a second or upper chain 62 extending over the upper sprocket 50, a first length 64 of elongate material extending through the boom portions 22 and 26 from one end of the lower chain 60 to one end of the upper chain 62, and a second length 66 of elongate material extending through the boom portions 22 and 26 from adjacent the opposite end of the lower chain 60 to the opposite end of the upper chain 62. As shown in FIG. 2, the first length 64 more particularly includes an insulator rod 68 connected to the lower end of the lower chain 60, an insulator rod 70 connected to the lower end of the upper chain 62, and a cable 72 connecting the insulator rods 68 and 70 and reeved over pulleys 58 and 61. The second length 66 includes an insulator rod 80 connected to the upper end of the lower chain 60, an insulator rod 82 connected to the upper end of the upper chain 62, and a cable 84 connecting the rods 80 and 82 and reeved over pulleys 59 and 61. The insulator rods prevent conduction of electricity through the articulated boom 20.

The closed loop 47 can be viewed as including a first section 92 comprising the lower end of the lower chain 60, the first length 64, and the lower end of the upper chain 62, and a second section 94 comprising the upper end of the lower chain 60, the second length 66, and the upper end of the upper chain 62. As can be appreciated by viewing FIG. 2, tension is maintained in the first section 92 by the force of gravity acting on the workman support bucket 34. The first section 92 is accordingly referred to as the tension section. The second section 94, which is referred to as the holdback section, is not maintained under tension by the force of gravity acting on the workman support bucket 34.

The aerial lift 14 also comprises means for maintaining tension in the closed loop 47, and preferably in the second or holdback section 94 of the closed loop 47. This means includes a hydraulic assembly 96 connected to the holdback section 94. In the preferred embodiment, the assembly 96 is interposed in the holdback section 94 and includes a hydraulic cylinder 98 having first and second or right and left ends, with the right end being connected to the insulator rod 80. The hydraulic assembly 96 also includes a piston 100 dividing the cylinder 98 into first and second or right and left chambers 102 and 104, respectively, and a piston rod 106 extending through the left chamber 104 and having one end fixedly connected to the piston 100 and an opposite end connected to the upper end of the lower chain 60. The right cylinder chamber 102 communicates with the atmosphere via a vent 103.

In the preferred embodiment, the tension maintaining means also includes (see FIG. 3) a hydraulic accumulator 108 communicating with the second or left cylinder chamber 104. Preferably, the hydraulic accumulator 108 is located inside the articulated boom 20, i.e., inside the housings 30 and 32, and communicates with the cylinder 98 via a conduit 110.

As best shown in FIG. 3, the hydraulic accumulator 108 includes a housing 112, and a flexible diaphragm 114 separating the housing 112 into a fluid chamber 116 and a gas chamber 118. The fluid chamber 116 communicates with the cylinder 98 via the conduit 110. The gas chamber 118 communicates with a source (not shown) of gas under pressure. As is known in the art, the gas in the gas chamber 118 is maintained at a desired pressure, and this maintains the fluid in the fluid chamber 116 at the desired pressure. Because the fluid chamber 116 communicates with the left cylinder chamber 104 via the conduit 110, the fluid in the left cylinder chamber 104 is also maintained at the desired pressure. Thus, the fluid in the left cylinder chamber 104 exerts on the hydraulic assembly 96 a force which tends to contract the hydraulic assembly 96 and which is equal to the fluid pressure times the area of the piston 100 within the left cylinder chamber 104. This force creates tension in the closed loop 47.

Since the hydraulic accumulator 108 maintains the fluid in the left cylinder chamber 104 at the desired pressure, the tension in the closed loop 47 is not affected by elongation of the loop 47. The hydraulic assembly 96 will simply contract to take up any slack. Once the hydraulic accumulator 108 is charged, it is not necessary to gain access to the interior of the boom 20 in order to adjust the tension in the holdback section 94. The tension is automatically maintained by the gas in the hydraulic accumulator 108.

It should be understood that while in the illustrated construction the leveling means includes a closed loop of elongate material, in alternative constructions the leveling means can include two separate lengths of elongate material.

Figure 4:
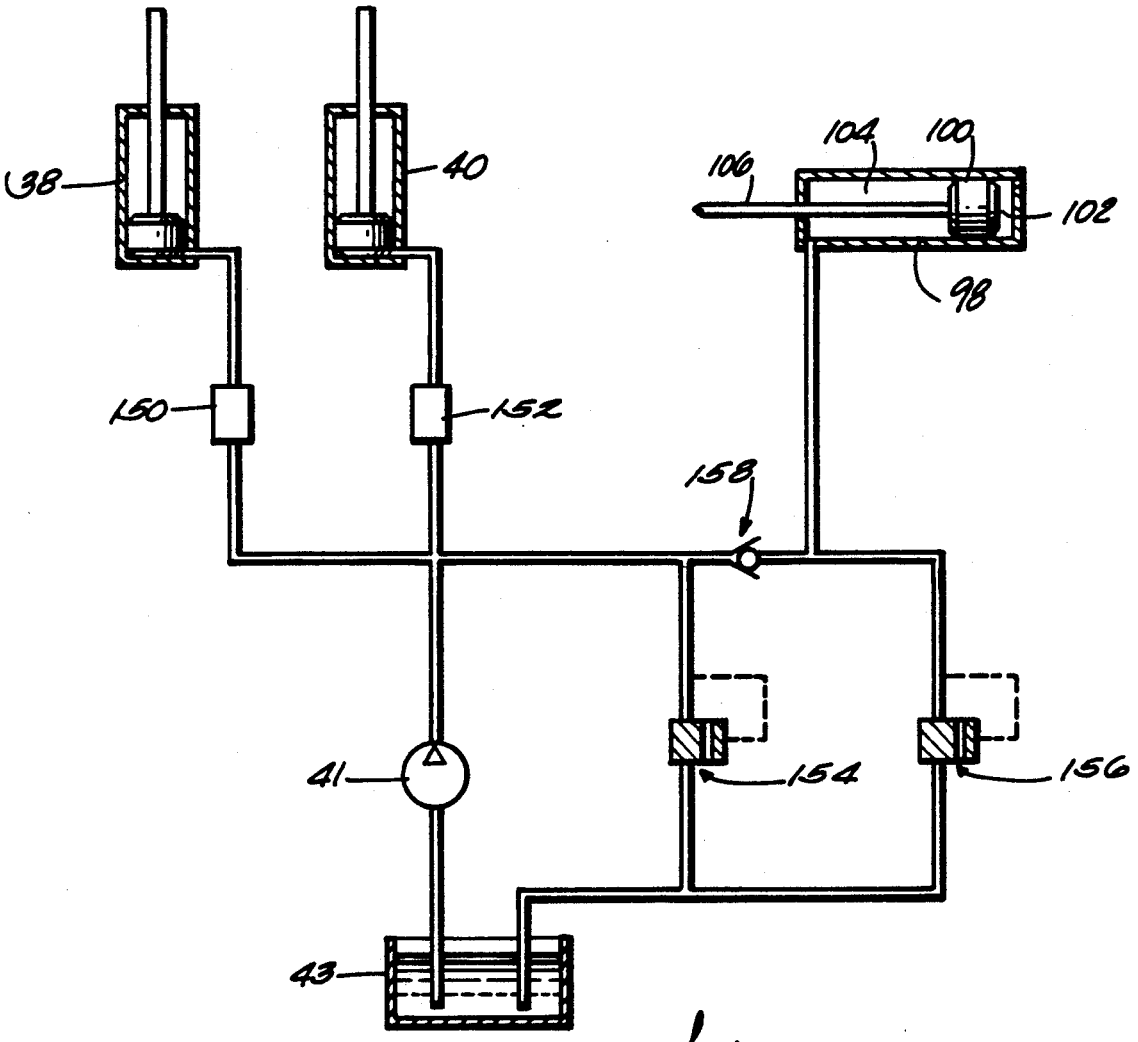
FIG. 4 is a schematic view of an alternative embodiment of the invention.

In an alternative embodiment of the invention, which is shown in FIG. 4, the left cylinder chamber 104 communicates with the pump 41 rather than with a hydraulic accumulator. More particularly, the chamber 104 communicates with the pump 41 via a pair of pressure reducing or relief valves 154 and 156, and via a check valve 158 which permits fluid flow to the chamber 104 and prevents fluid flow from the chamber 104. Therefore, the chamber 104 is pressurized to the desired pressure (set by the valves 154 and 158 each time the pump 41 is turned on.

In another alternative embodiment (not shown), the pump 41 can be connected to the fluid chamber 116 of the accumulator 108, so that the fluid chamber 116 is pressurized every time the pump 41 is turned on.

Other features and advantages of the invention are set forth in the following claims.

I claim:

1. An aerial lift comprising a frame, an articulated boom including a first boom portion having an upper end, and a lower end pivotally mounted on said frame for pivotal movement relative thereto about a generally horizontal axis, means for causing pivotal movement of said first boom portion relative to said frame, a second boom portion having an upper end, and a lower end mounted on said upper end of said first boom portion for pivotal movement relative thereto about a generally horizontal axis, means for causing pivotal movement of said second boom portion relative to said first boom portion, a workman support structure mounted on said upper end of said second boom portion for pivotal movement relative thereto about a generally horizontal axis, and means for leveling said workman support structure throughout the range of movement of said first and second boom portions, said means for leveling including a first section of elongate material extending through said first and second boom portions from said lower end of said first boom portion to said workman support structure, and a second section of elongate material extending through said first and second boom portions from said lower end of said first boom portion to said workman support structure, and means for maintaining tension in said second section, said means for maintaining tension including a hydraulic assembly connected to said second section and including a hydraulic cylinder, a piston dividing said cylinder into first and second chambers, and a piston rod having one end fixedly connected to said piston, and a hydraulic accumulator communicating with one of said chambers.

2. An aerial lift as set forth in claim 1 wherein said hydraulic accumulator is located inside said articulated boom and communicates with said cylinder via a conduit.

3. An aerial lift as set forth in claim 1 wherein tension is maintained in said first section by the force of gravity acting on said workman support structure.

4. An aerial lift as set forth in claim 1 wherein said means for leveling includes a closed loop of elongate material, said closed loop including said first and second sections.

5. An aerial lift as set forth in claim 4 wherein said means for leveling includes a first sprocket connected to said frame, and a second sprocket connected to said workman support structure, and wherein said closed loop includes a chain extending over said first sprocket, and a chain extending over said second sprocket.

6. An aerial lift as set forth in claim 1 wherein said hydraulic assembly divides said second section into first and second segments, wherein said cylinder is connected to one of said segments, and wherein said piston rod has an opposite end connected to the other of said segments.

7. An aerial lift as set forth in claim 6 wherein said cylinder has first and second ends respectively adjacent said first and second chambers, wherein said first end of said cylinder is connected to said one of said segments of said second section, wherein said piston rod extends through said second chamber, and wherein said hydraulic accumulator communicates with said second chamber.

8. An aerial lift comprising a frame, an articulated boom including a first boom portion having an upper end, and a lower end pivotally mounted on said frame for pivotal movement relative thereto about a generally horizontal axis, a second boom portion having an upper end, and a lower end mounted on said upper end of said first boom portion for pivotal movement relative thereto about a generally horizontal axis, first means for causing pivotal movement of said first boom portion relative to said frame, second means for causing pivotal movement of said second boom portion relative to said first boom portion, at least one of said first and second means including a hydraulic assembly and a hydraulic pump communicating with said hydraulic assembly, a workman support structure mounted on said upper end of said second boom portion for pivotal movement relative thereto about a generally horizontal axis, and means for leveling said workman support structure throughout the range of movement of said first and second boom portions, said means for leveling including a first section of elongate material extending through said first and second boom portions from said lower end of said first boom portion to said workman support structure, and a second section of elongate material extending through said first and second boom portions from said lower end of said first boom portion to said workman support structure, and means for maintaining tension in said second section, said means for maintaining tension including a second hydraulic assembly connected to said second section and including a hydraulic cylinder, and a piston dividing said cylinder into first and second chambers, one of said chambers constantly communicating with said pump via valve means for permitting flow to said one of said chambers and for preventing flow from said one of said chambers, and said second hydraulic assembly also including a piston rod having one end fixedly connected to said piston.

9. An aerial lift as set forth in claim 8 wherein said pump also communicates with said cylinder via a pressure reducing valve.

10. An aerial lift as set forth in claim 8 wherein tension is maintained in said first section by the force of gravity acting on said workman support structure.

11. An aerial lift as set forth in claim 8 wherein said means for leveling includes a closed loop of elongate material, said closed loop including said first and second sections.

12. An aerial lift as set forth in claim 11 wherein said means for leveling includes a first sprocket connected to said frame, and a second sprocket connected to said workman support structure, and wherein said closed loop includes a chain extending over said first sprocket, and a chain extending over said second sprocket.

13. An aerial lift as set forth in claim 8 wherein said hydraulic assembly divides said second section into first and second segments, wherein said cylinder is connected to one of said segments, and wherein said piston rod has an opposite end connected to the other of said segments.

14. An aerial lift as set forth in claim 13 wherein said cylinder has first and second ends respectively adjacent said first and second chambers, wherein said first end of said cylinder is connected to said one of said segments of said second section, wherein said piston rod extends through said second chamber, and wherein said pump communicates with said second chamber.

15. An aerial lift comprising a frame, an articulated boom including a first boom portion having an upper end, and a lower end pivotally mounted on said frame for pivotal movement relative thereto about a generally horizontal axis, means for causing pivotal movement of said first boom portion relative to said frame, a second boom portion having an upper end, and a lower end mounted on said upper end of said first boom portion for pivotal movement relative thereto about a generally horizontal axis, means for causing pivotal movement of said second boom portion relative to said first boom portion, a workman support structure mounted on said upper end of said second boom portion for pivotal movement relative thereto about a generally horizontal axis, and means for leveling said workman support structure throughout the range of movement of said first and second boom portions, said means for leveling including a first sprocket connected to said frame, a second sprocket connected to said workman support structure, and a closed loop of elongate material extending through said first and second boom portions, said closed loop including a first chain having opposite ends and extending over said first sprocket, a second chain having opposite ends and extending over said second sprocket, a first length of elongate material extending from one end of said first chain to one end of said second chain, said first length being maintained under tension by the force of gravity acting on said workman support structure, and a second length of elongate material extending from adjacent the opposite end of said first chain to the opposite end of said second chain, and means for maintaining tension in said second length, said means for maintaining tension including a hydraulic cylinder having first and second ends, said first end being connected to one of said second length and said opposite end of said first chain, a piston dividing said cylinder into first and second chambers respectively adjacent said first and second ends, a piston rod extending through said second chamber and having one end fixedly connected to said piston and an opposite end connected to the other of said second length and said opposite end of said first chain, and a hydraulic accumulator located inside said articulated boom and communicating with said second chamber of said cylinder.

* * * * *